United States Patent [19]

Cloutier

[11] 4,206,923

[45] Jun. 10, 1980

[54] DICE BLOCK PUZZLE

[76] Inventor: Maurice Cloutier, 6616 Louis Hébert St., Montreal, Quebec H2G 2G7, Canada

[21] Appl. No.: 938,538

[22] Filed: Aug. 31, 1978

[51] Int. Cl.[2] ..... A63F 9/12

[52] U.S. Cl. ..... 273/160

[58] Field of Search ..... 273/156, 157 R, 160, 273/146

[56] References Cited

U.S. PATENT DOCUMENTS

| | | | |
|---|---|---|---|
| 3,612,537 | 10/1971 | Sato | 273/156 |
| 3,721,446 | 3/1971 | Young | 273/157 R |
| 3,827,162 | 8/1974 | Moeser | 273/160X |
| 3,829,101 | 8/1974 | Betzoldt | 273/160 |

FOREIGN PATENT DOCUMENTS

| | | | |
|---|---|---|---|
| 563788 | 7/1975 | Switzerland | 273/156 |

*Primary Examiner*—Anton O. Oechsle

[57] ABSTRACT

A dice block puzzle toy is disclosed. The toy comprises a dice-shaped major body having a plurality of through-holes in each pair of opposite faces and notched rods for insertion into the through-holes whereby only one order of assembly is possible.

3 Claims, 14 Drawing Figures

4

3a
7
5
3b
5
6

8
9
3c 11
12
10
3d 13
14
3e 16
15
3f 17
18
3g 19
20
21
3h 22
24
3i
23

25
3j

3k

DICE BLOCK PUZZLE

FIELD OF THE INVENTION

This invention relates to a toy, and more particularly to a toy having a plurality of parts which are to be assembled into a predetermined assembly having the shape and appearance of a die.

It is very desirable to have a toy which is not only amusing and entertaining but educational as well, especially in view of the fact that the toy is designed for use mainly by children.

SUMMARY OF THE INVENTION

According to the present invention there is provided a toy comprising a multi-faced body having pairs of parallel faces and having a plurality of through-holes perpendicular to and opening at the respective pairs of faces, at least some of said through-holes are intersecting, and a plurality of rods for insertion into the through-holes, at least some of said rods being notched.

Inside the multi-faced body, most of the through-holes intersect one another in various degrees. To accomodate these intersections the rods are notched to different depths and in different configurations. Thus the design of the toy is such that the rods must be inserted in their proper holes and in a certain sequence to complete the puzzle.

It is therefore a primary object of the present invention to provide a toy which is not only amusing and entertaining but provides a chance to the user to think logically and deeply about three dimensional space.

It is an another object of the present invention to provide a toy which is inexpensive to manufacture.

It is a further object of the present invention to provide a toy which can be purely decorative when not in use.

Other object and features of the present invention will be made apparent by referral to the following preferred embodiment of the invention illustrated by way of the accompanying drawings in which:

DESCRIPTION OF A PREFERRED EMBODIMENT

The multi-faced body 1 is boxlike in structure made preferably of wood or plastic, preferably transparent plastic for decorative purposes. It provides a plurality of pairs of parallel opposite faces. Body 1 is preferably a cube and therefore has three pairs of parallel faces mutually perpendicular. Body 1 is provided with a plurality of sets of through bores 2 of equal cross-sectional size and preferably of circular cross-section. There are as many sets of through bores 2 as there are pairs of faces. Through bores 2 open at and are perpendicular to the associated pair of faces.

Figure 1:
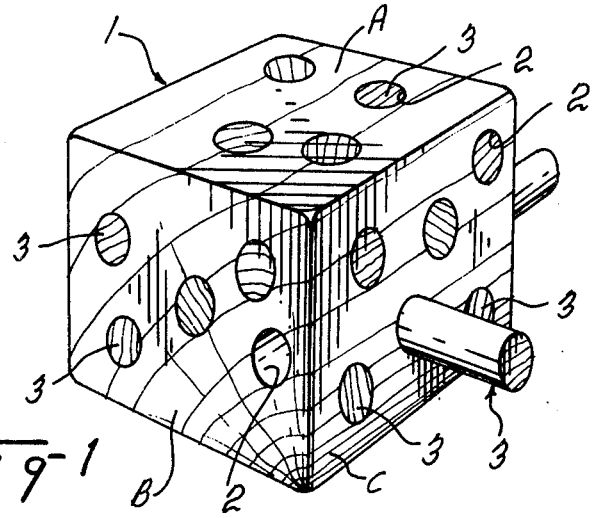
FIG. 1 is a perspective view of the puzzle toy.
Figure 2:
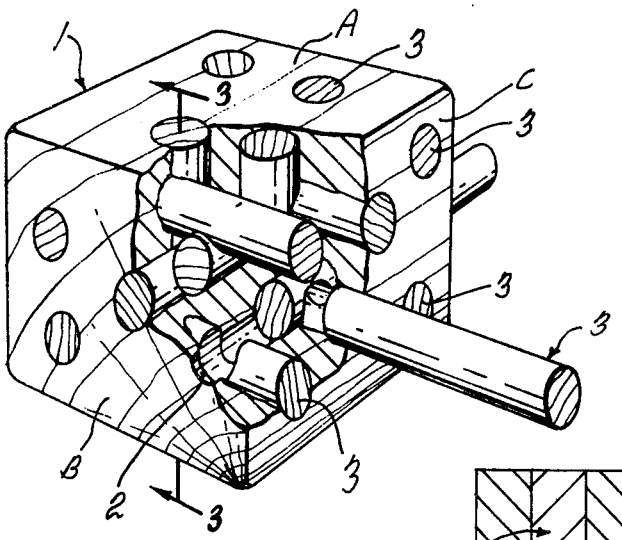
FIG. 2 is a perspective view of the puzzle toy, partially broken away, showing how the rods intersect.
Figure 3:
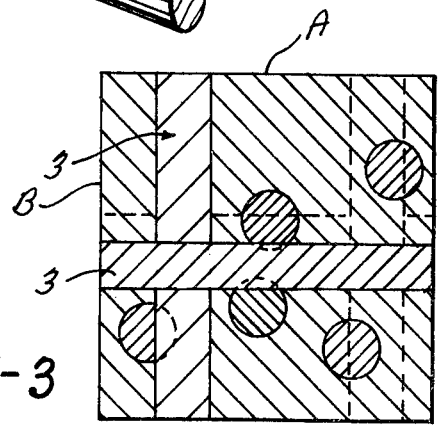
FIG. 3 is a cross-sectional view taken along line 3—3 of FIG. 2.

As best shown in FIG. 3, most through-bores 2 intersect in criss-cross fashion inside body 1 and to various degrees. Each pair of opposite faces preferably has a different number of through bores 2: for instance, faces A have four through bores 2; faces B have five through bores 2 and faces C have six through bores 2.

It will be readily understood that more or less through bores 2 could be easily be provided. In the preferred embodiment there is a total of fifteen through bores 2.

Rods 3, all of equal length and diameter, removably slidably fit into through-bores 2 with the ends of the rods flush with the respective faces A, B and C. To accomodate the criss-cross intersections of through bores 2 in body 1, most of the rods 3 are notched in varying degrees of depth, at various distances from their ends and at various orientations around the rods. It will readily be appreciated that each rod, with the exception of the unnotched rods shown in FIG. 14 and of which there are four, must be inserted into their proper corresponding through bores 2. Also, a certain definite sequence of assembly must be followed to successfully assemble the puzzle. For example, if the rod shown in FIG. 8 were to be inserted into the through bore 2 reserved for the rod of FIG. 11, it is clear that a player would be able to assemble the puzzle to a certain point and no further, since the notches of the FIG. 8 rod would not correspond fully to the through bore intersections inside body 1. There is only one correct order of assembly. It is to be noted that, by changing the notches on the fifteen rods and, consequently, changing the order of assembly, a possible total of two hundred and twenty-five ways of assembly exist, using the same block with the same arrangement of through bores.

Figures 4, 5, 6, 7, 8, 9, 10, 11, 12, 13, 14:
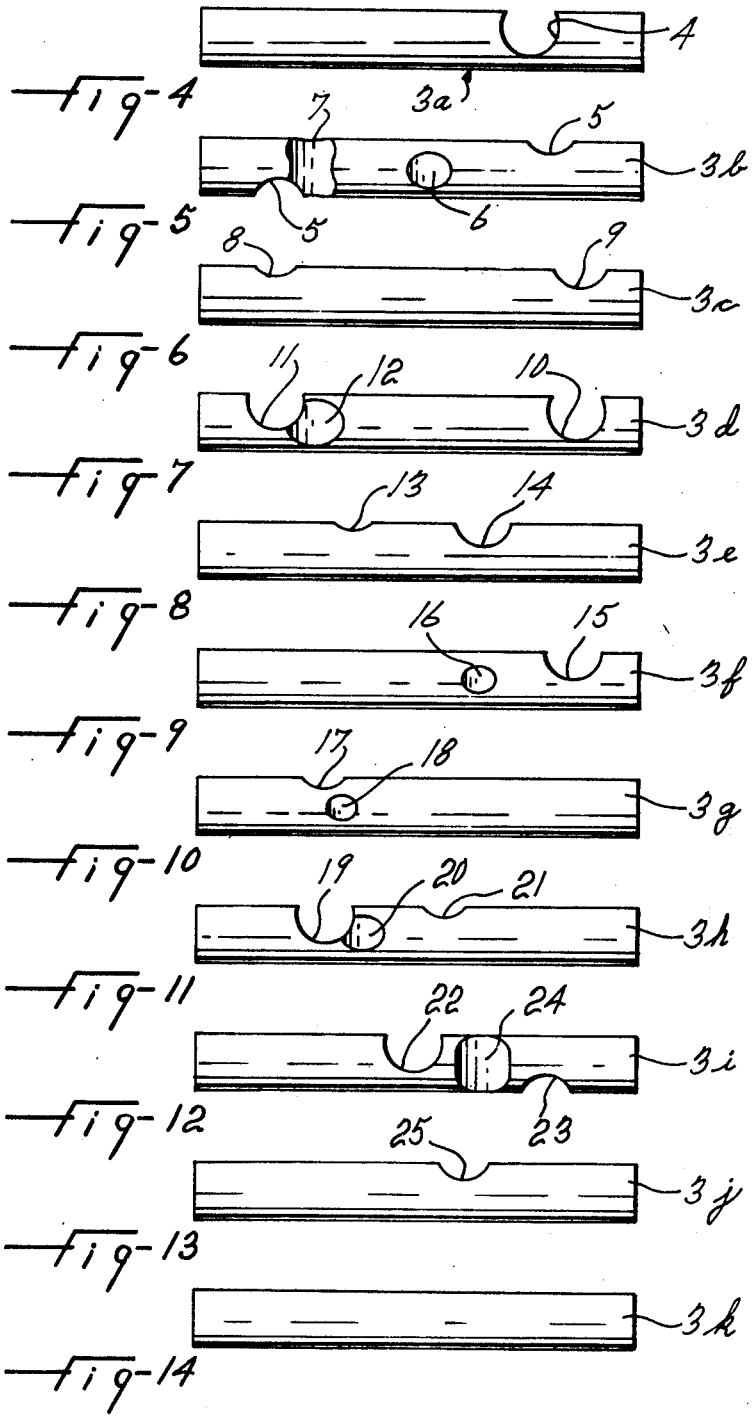
FIGS. 4–14 inclusively show the eleven different types of rods used with the cubic body. Like numerals refer to like elements throughout the drawings.

Referring now to FIGS. 4 to 14, FIG. 4 shows a rod **3*a* having a single transverse notch 4 substantially three quarters of the diameter of the notch. FIG. 5 shows a rod 3*b* having four notches: two are diametrically opposite each other and are located near each end of rod 3*b*, indicated by the numeral 5. Two more notches, 6 and 7, are disposed orthogonally with respect to notches 5. Notch 6 is in the middle of rod 3*b* and is fairly shallow, and notch 7 is substantially deeper than notch 6 and partially intersects one of the notches 5**.

In FIG. 6, rod **3*c* is shown. It has two notches 8 and 9 near the ends thereof. Notch 8 is substantially one-fifth the diameter of rod 3*c***.

Referring to FIG. 7, rod **3*d* has three notches therein. Notch 10 is located near one end of rod 3*d* and its depth is substantially three quarters the diameter of the rod. A slightly shallower notch 11 is located adjacent the other end of rod 3*d*. The third notch 12 is orthogonal to, and partially intersects notch 11**, being located inwardly of the same.

In FIG. 8, a rod **3*e* is shown having only two notches therein. Notches 13 and 14 are located at approximately an equal distance on each side of the center of the rod 3*e*. As shown the notch 13 is substantially shallower than notch 14**, and both notches are parallel to each other.

FIG. 9 shows a rod **3*f* also having only two notches. In this case, notches 15 and 16 are orthogonally disposed adjacent one end of rod 3*f* with notch 15, the deeper notch, cutting into substantially one half the diameter of the rod and notch 16** being located inwardly of the former and is relatively shallow.

In FIG. 10, rod **3*g* is depicted, again having only two notches 17 and 18 located approximately midway between one end of rod 3*g* and its center. Notch 17 is relatively shallow and notch 18 is even shallower, being orthogonal to the former and located slightly inwardly of notch 17** but not intersecting the same.

FIG. 11 shows rod 3*h* having three notches cut therein. Notch 19 is fairly deep, about half the diameter of the rod. Notch 20 is orthogonally disposed to the former and to notch 21 and is located there between, partially intersecting notch 19. Notches 20 and 21 are substantially of the same depth.

FIG. 12 shows a rod 3*i* having three notches, but in different configuration as compared to the other notched rods: notch 22 is located at the center of rod 3*i* and is a little over half the diameter of rod 3*i* in depth. Notch 23, substantially shallower than the former is diametrically opposite the same and notch 24, substantially the same depth as notch 23, is orthogonal to both notches 22 and 23 and is located exactly between the two.

FIG. 13 shows rod 3*j* having only one notch 25 which is located slightly outwardly of the center of rod 34 and is substantially the same depth as notch 23 of rod 3*i*.

Finally FIG. 14 shows an example of rod 3*k* without any notches. There are four such rods in the puzzle.

The arrangement of through bores 2 at faces A, B and C of block 1 naturally corresponds to the arrangement of the notches on the rods 3. Block 1 could be hollow if so desired. When block 1 is transparent and rods 3 of various colours, the assembled puzzle is highly decorative and can be placed on a stand.

The rods could have another cross-sectional shape than the circular shape shown. Any multifaced rod could be used.

Also, rods of different cross-sectional shapes could be used with the same block, the through bores being shaped accordingly.

What I claim is:

1. A block puzzle toy comprising a multi-faced body having at least three pairs of parallel equally spaced opposite faces, said body having as many sets of through bores as there are pairs of faces, with the through bores of each set opening at and being perpendicular to the associated pair of faces, at least some of the through-bores of one set partially intersecting through bores of another set, and a plurality of rods all of the same length equal to the distance between the faces of any pair of faces and removable from said multi-faced body, corresponding to the number of through-bores, for insertion into the latter such that the ends of said rods are flush with their corresponding faces when fully inserted and all said rods extend entirely through said multi-faced body when inserted, some of said rods being notched in at least one place along their length to accomodate said intersections wherein only one axial orientation of the notched rods is possible and whereby only one order of assembly is possible out of several possible combinations.

2. A block puzzle toy as claimed in claim 1, wherein the through-bores of one set partially intersect the through-bores of two other sets, and some of the notched rods are correspondingly provided with more than one notch.

3. A block puzzle toy as claimed in claims 1 or 2, wherein the degree of intersection of the through bores varies and the depth of the notches in the notched rods varies accordingly.

* * * * *